US008695928B1

(12) United States Patent
Schalk

(10) Patent No.: US 8,695,928 B1
(45) **Date of Patent: *Apr. 15, 2014**

(54) RAILROAD SWITCH INDICATOR WITH DISTANCE AMPLIFIER

(76) Inventor: David A. Schalk, Festus, MO (US)

( * ) Notice: Subject to any disclaimer, the term of this patent is extended or adjusted under 35 U.S.C. 154(b) by 85 days.

This patent is subject to a terminal disclaimer.

(21) Appl. No.: 12/843,011

(22) Filed: Jul. 24, 2010

Related U.S. Application Data

(60) Provisional application No. 61/228,300, filed on Jul. 24, 2009.

(51) Int. Cl.
*B61L 5/12* (2006.01)

(52) U.S. Cl.
USPC ..... 246/476

(58) Field of Classification Search
USPC ..... 246/473 R, 473.3, 474–476; 116/2, 4, 116/12, 20, 28 R, 30, 35 R, 45, 50, 63 R; 40/368, 370, 375, 489–491
See application file for complete search history.

(56) References Cited

U.S. PATENT DOCUMENTS

| | | | | |
|---|---|---|---|---|
| 366,277 | A | 7/1887 | Thomas et al. | |
| 612,973 | A | 10/1898 | Lewis | |
| 824,270 | A | 6/1906 | Zorge | |
| 1,056,706 | A | 3/1913 | Melick | |
| 1,885,460 | A | 11/1932 | McElhaney | |
| 2,278,213 | A | 3/1942 | Quenon | |
| 2,740,041 | A | 3/1956 | Marcum | |
| 3,544,960 | A | 12/1970 | Hayes | |
| 4,837,957 | A | 6/1989 | Egender | |
| 5,117,765 | A | 6/1992 | Wahl | |
| 5,192,038 | A | 3/1993 | Ocampo | |
| 5,791,605 | A | 8/1998 | Howie, II | |
| 5,806,809 | A | 9/1998 | Danner | |
| 6,427,949 | B1 | 8/2002 | Hager et al. | |
| 7,735,784 | B2 * | 6/2010 | Schalk | 246/476 |

* cited by examiner

*Primary Examiner* — R. J. McCarry, Jr.
(74) *Attorney, Agent, or Firm* — Grace J. Fishel

(57) ABSTRACT

A railroad switch indicator for visually signaling the position of a pair of railroad switchpoints independently of the mechanism for operating the switch. The indicator includes a sleeve with windows in which is reciprocated a slide with reflectors selected ones of which are visible through the windows of the sleeve for indicating safety conditions of the track. An arm with an upwardly extending finder is attached to a transverse bar that moves the switchpoints. The finger engages the slide through lever arms. When the finger moves with the switchpoints, the lever arms move the slide a distance greater than the distance moved by the finger thereby increasing the sensitivity of the railroad switch indicator to movement of the switchpoints. Movement of the slide by the finger is resisted by springs or counterweights which urge the slide into a mid or default position signaling caution.

14 Claims, 12 Drawing Sheets

RAILROAD SWITCH INDICATOR WITH DISTANCE AMPLIFIER

This application claims priority from provisional application Ser. No. 61/228,300, filed Jul. 24, 2009, for Railroad Switch Indicator with Distance Amplifier.

BACKGROUND OF THE INVENTION

1. Field of the Invention

The present invention relates to a railroad switch indicator positioned between the stockrails for visually signaling the position of a pair of railroad switchpoints independently of the mechanism for operating the switch. The switch indicator includes a mechanism that amplifies a small movement of the switchpoints and that defaults to a position signaling caution.

2. Brief Description of the Prior Art

In order to optionally switch a railroad train operating on one track to a second track, it is typical to provide a switch with a pair of switchpoints which are selectively movable horizontally to deflect the train toward one or the other of the tracks. The switchpoints may be driven by a manual or electrical powered mechanism. A signal is usually associated with the mechanism for operating the switch to visually indicate how the switch is lined. If a train runs through the switch or if the switchpoints are moved by vibrations of a train rolling over the track, the switchpoints may be moved into a mid position which is not reflected by the signal associated with the mechanism for operating the switch.

When a train runs through a switch, a flange on the wheels picks open the switchpoints. Depending on how sharp the wheels are, the distance that the switchpoints move may be much less than an inch and yet a misalignment of as little as 0.25 inch may result in a disastrous derailment. Manual mechanisms commonly miss such a small movement and even sophisticated electrically powered switch mechanisms with sensors for open and closed switchpoints may give a false signal.

BRIEF SUMMARY OF THE INVENTION

In view of the above, it is an object of the present invention to provide a railroad switch indicator that operates independently of the mechanism for operating the switch. It is another object to provide a railroad switch indicator that signals movements of the switchpoints that may be missed by the mechanism for operating the switch and that defaults to a safe position signaling caution. It is also an object to provide a railroad switch indicator that does not depend on electricity and can be used with mechanically operated switches as well as electrically powered switches. Other objects and features of the invention will be in part apparent and in part pointed out hereinafter.

In accordance with the invention, a railroad switch indicator for use with a switch for switching a railroad train is provided. The switch includes a pair of stockrails and a pair of switchrails with the switchrails having first ends secured to a track bed and second ends terminating with switchpoints. The switchpoints are connected by a traverse bar for conjoint lateral movement of the switchpoints between switching and nonswitching positions.

The railroad switch indicator has a first bracket adapted to be attached to the track bed between the pair of switchpoints. The bracket supports a sleeve between and transverse to the stockrails and sleeve has front and rear walls with regularly formed spaced apart windows. Each of a first and second lever arm has a first end pivoted to the sleeve and a second end pivoted to a slide inside of the sleeve either directly or indirectly through a linkage including other lever arms pivoted to the sleeve. The slide has front and rear walls with reflectors, alternate ones forming a first and second set in different colors to indicate safety conditions of the track, the reflectors being visible through the windows of the sleeve.

A second bracket is adapted to be attached to the transverse bar connected to the switchpoints. The bracket supports a longitudinally extending arm with an upwardly extending finger which engages the lever arms for reciprocation of the slide within the sleeve conjointly with movement of the switchpoints by the transverse bar. The lever arms move the slide a greater distance than the distance moved by the finger thereby reducing the distance needed to signal a change in the switchpoints.

In use, the first set of reflectors are visible through the windows of the sleeve when the switchpoints are in a switching position, the second set of reflectors are visible through the windows of the sleeve when the switchpoints are in a nonswitching position and portions of the first and second set of reflectors are visible when the switchpoints are in a mid position indicating a dangerous condition. A biasing system works against the force of the finger urging the slide into the mid position.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
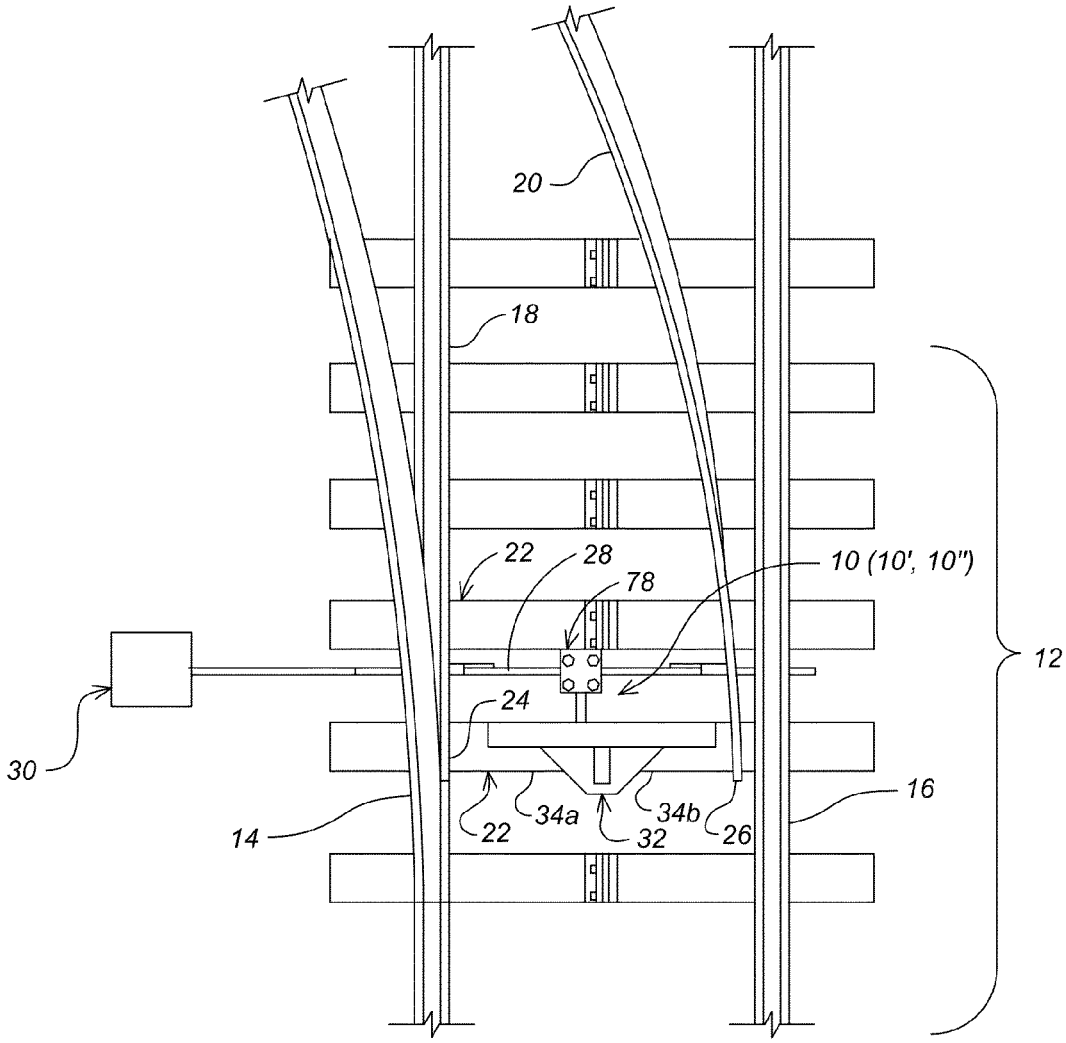
FIG. 1 is a plan view of a railroad switch provided with a railroad switch indicator in accordance with the present invention.

Referring to the drawings more particularly by reference character and beginning with FIG. 1, reference numeral 10 refers to a railroad switch indicator for use with a railroad switch 12 for switching a railroad train from one track to another. A first railroad switch indicator 10' is shown in FIGS. 4 through 8 and a second railroad switch indicator 10" is shown in FIGS. 9 through 11C.

Railroad switch 12 normally comprises a pair of fixed outer stockrails 14, 16 and pair of inner switchrails 18, 20. Stockrails 14, 16 are anchored to a plurality of cross ties 22 in a track bed. Inner switchrails 18, 20 have one end rigidly secured to the track bed and the opposite end terminating in laterally spaced switchpoints 24, 26 arranged for conjoint lateral movement between laterally spaced switching and nonswitching positions. A transverse bar 28 connects inner rails 18, 20 for moving switchpoints 24, 26 conjointly from one position to another. Transverse bar 28 may be manually operated or electrically powered by a conventional mechanism 30.

As shown in FIG. 1, switchpoints 24, 26 are in nonswitching position with switchpoint 24 positioned against stationary left stockrail 14 and switchpoint 26 moved away from stationary right stockrail 16. In nonswitching position, switchpoint 24 will direct a train entering switch 12 straight through the intersection via right stockrail 16 and switchrail 18 which tapers outward into a straight left rail past switch 12. In a reverse position (not shown), both switchpoints are moved to the right with switchpoint 24 thus moved away from left stockrail 14 and switchpoint 26 moved to a position against right stockrail 16. Switchpoint 26 is thus in a position to direct the train to the left via left stockrail 14 which curves to the left past switch 12, and via right switchrail 20 which tapers outward to a curved right track past switch 12.

With continuing reference to FIG. 1, switch 12 is lined against a train curving to the left. If a train runs through switch 12 from the curved section, switchpoints 24, 26 will be pushed into a mid position such that they contact neither left nor right stockrails 14, 16 and a train coming through switch 12 from bottom to top may derail if the operator depends on the signals associated with mechanism 30 for moving switch points 24, 26 if they falsely indicate that switch 12 remains lined for straight through travel.

Figure 2A:
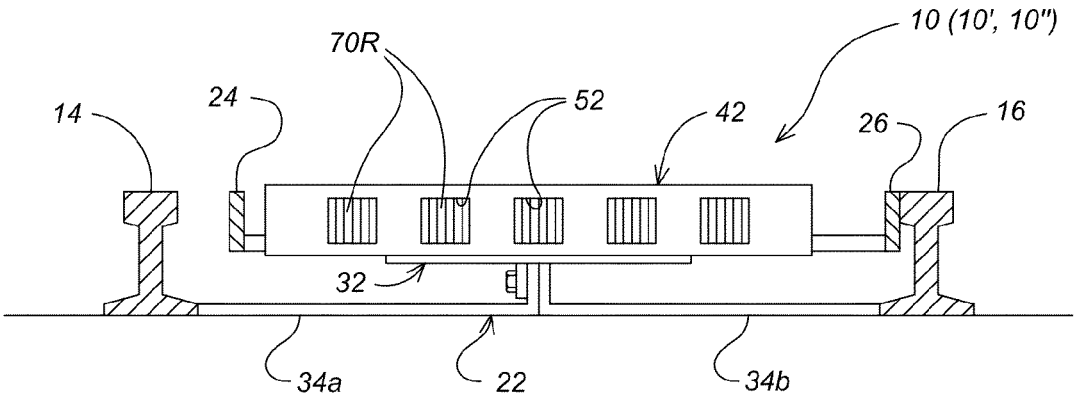
FIG. 2A is a side elevation of the railroad switch indicator signaling that a right switchpoint is in contact with a right stockrail.
Figure 2B:
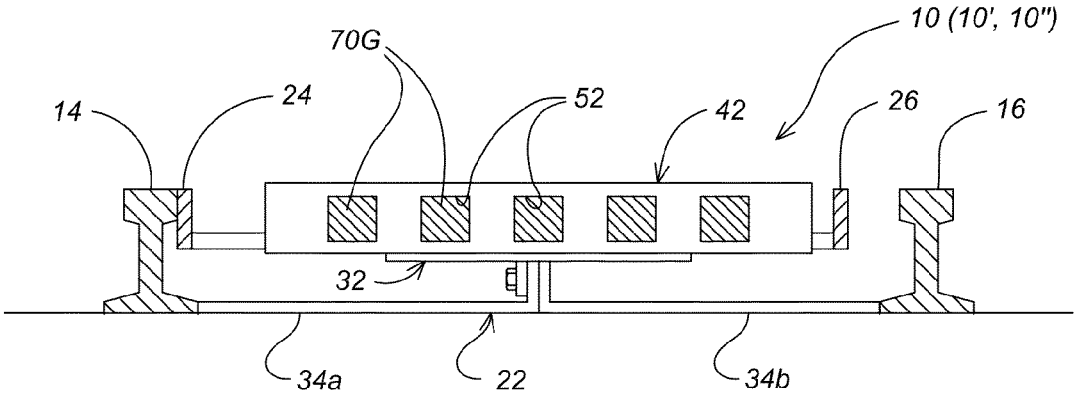
FIG. 2B is a side elevation of the railroad switch indicator signaling that a left switchpoint is in contact with a left stockrail.
Figure 2C:
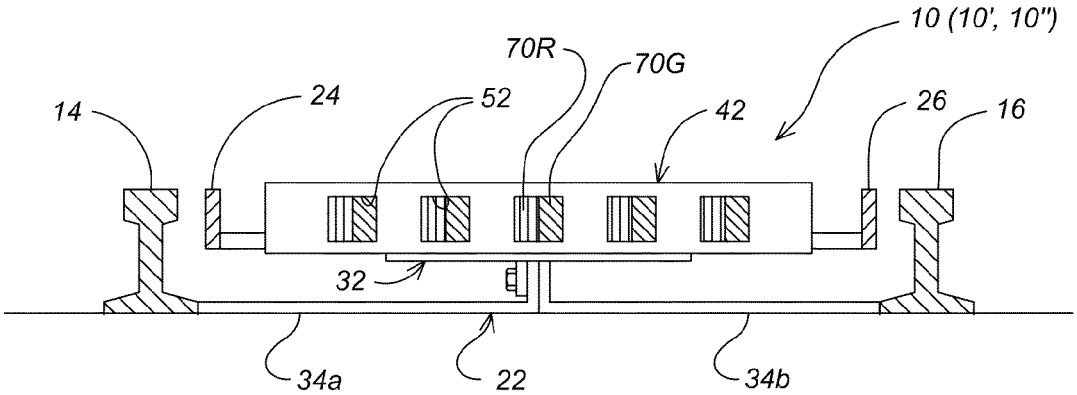
FIG. 2C is a side elevation of the railroad switch indicator signaling danger that the switchpoints are in a mid position.
Figure 3:
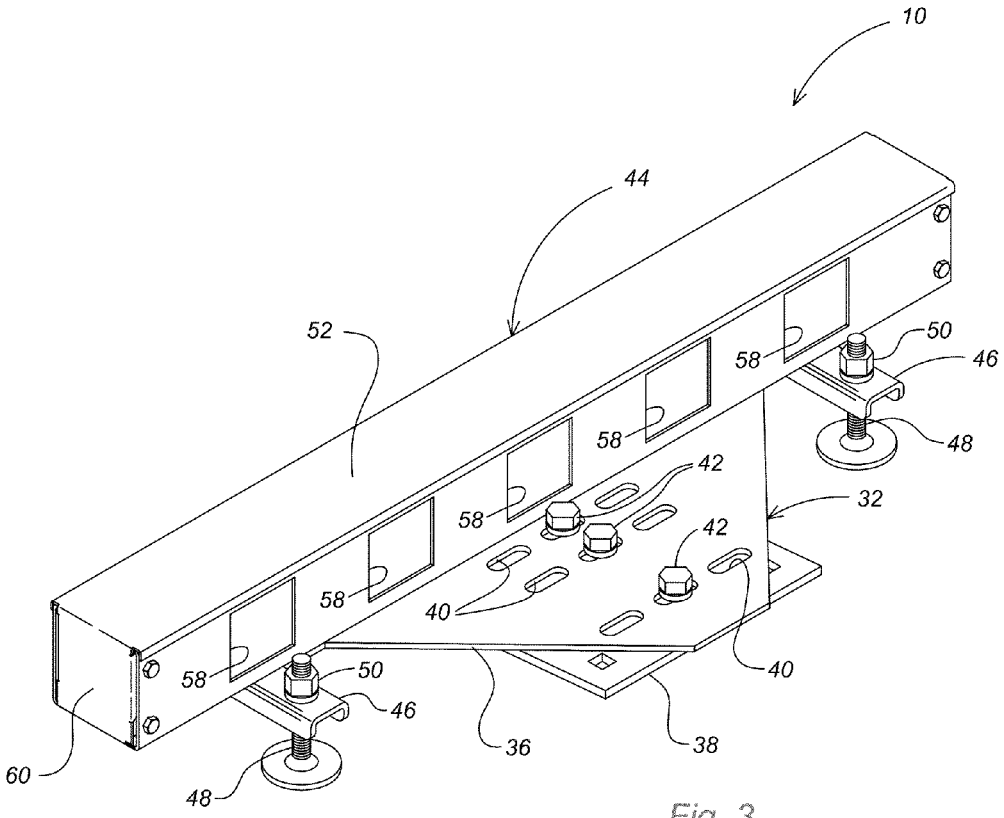
FIG. 3 is perspective view of the railroad switch indicator.
Figure 11A:
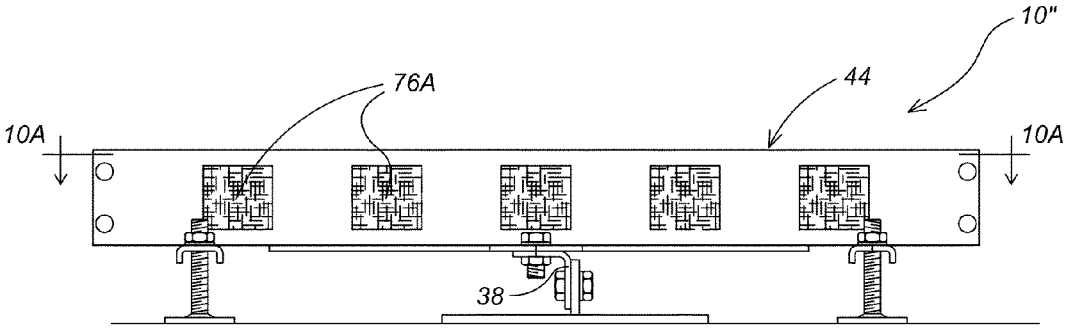
FIG. 11A is a side elevation of the second railroad switch indicator signaling a switching condition.
Figure 10B:
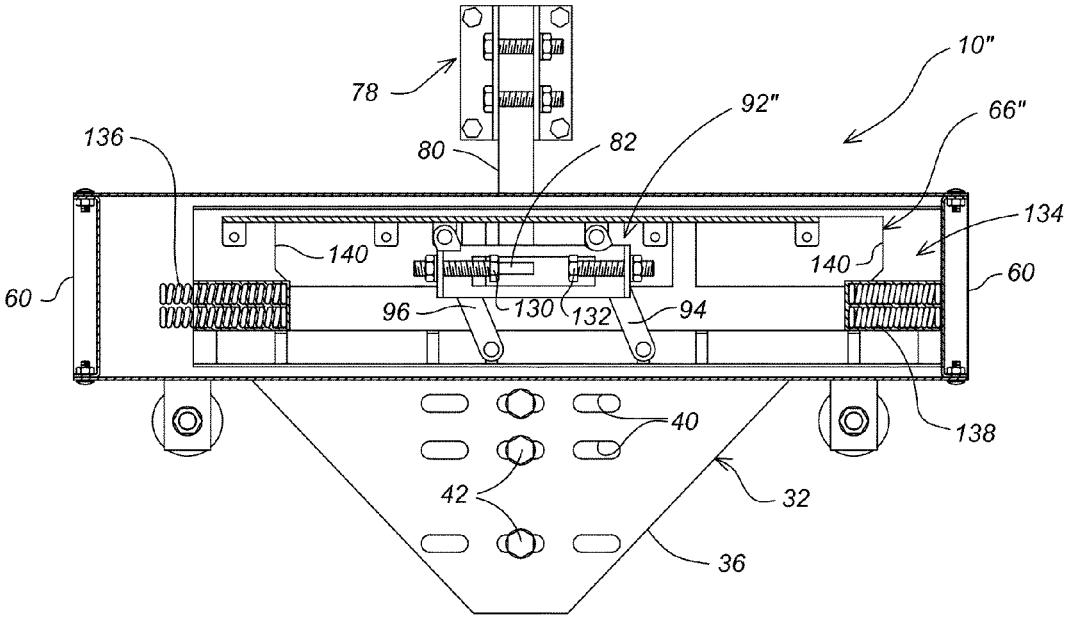
FIG. 10B is a sectional view like FIG. 10A but with lever arms pivoted to an extreme left with switchpoint 24 in contact with stockrail 14.
Figure 11B:
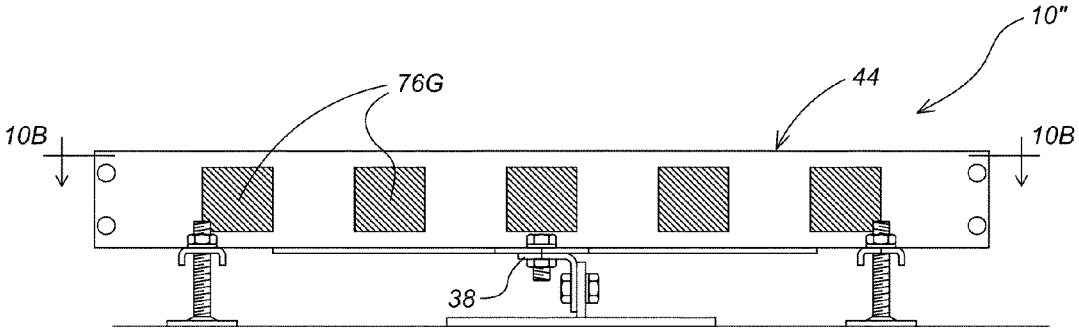
FIG. 11B is a side elevation of the second railroad switch indicator signaling a nonswitching condition.
Figure 10C:
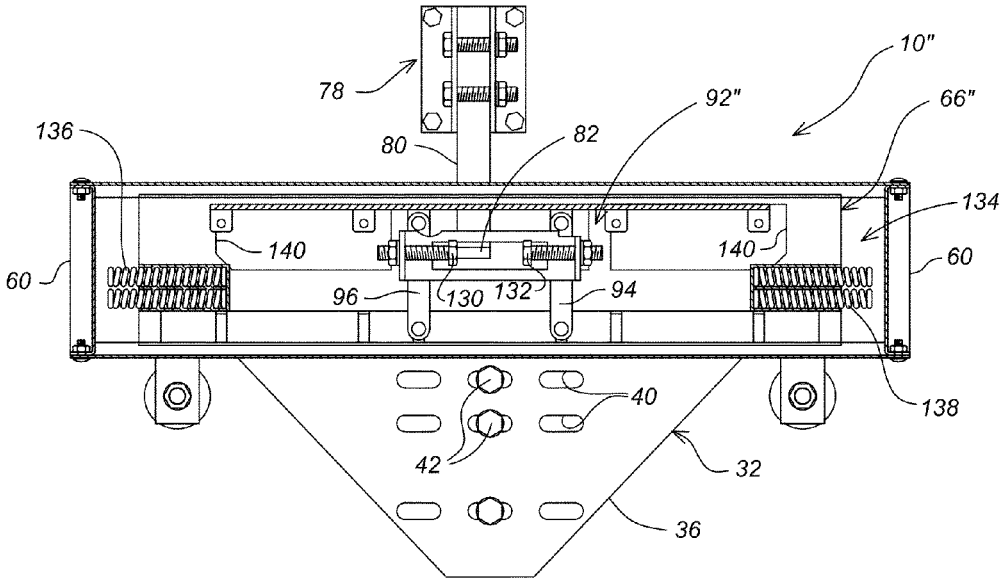
FIG. 10C is a side elevation like FIGS. 10A and 10B but wherein the arms are not in extreme right or left position indicating that the switchpoints are not in proper contact with either of stockrails 14 or 16; and, FIG. 11C is a side elevation of the second railroad switch indicator signaling danger.
Figure 11C:
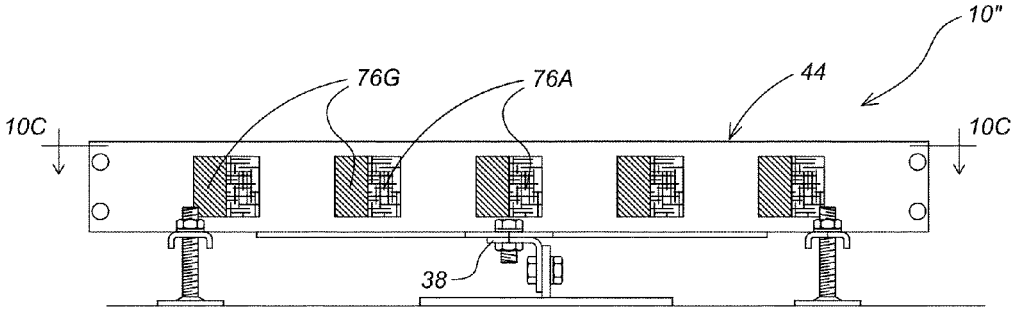

As shown in FIG. 1, railroad switch indicator 10 (10', 10") operates independently of mechanism 30 and includes a first bracket 32 which is adapted to be attached to one of cross ties 22 near switchpoints 24, 26. For example, when cross tie 22 is formed of metal as shown in FIGS. 2A-2C, it may include two flanged sections 34*a*, 34*b* separated with insulation such that the metal cross tie does not interfere with electrical signals passed down the track. As shown in FIG. 3, bracket 32 includes a triangular shaped plate 36 which is cantilevered to flanged sections 34*a* 34*b* of metal cross tie 22 by an L-shaped support 38 as best seen in FIGS. 11A-11C. Triangular plate 36 is attached to a horizontal leg of L-shaped support 38 by bolts received in elongated holes 40. Three columns of holes 40 are provided to facilitate mounting on different tracks while elongated holes 40 permit limited lateral adjustment as nuts 42 are tightened.

An elongated rectangular sleeve 44 is fixedly mounted on first bracket 32 (e.g., with suitable fasteners or by welding). Sleeve may be given additional support with outriggers 46 mounted on bolts 48 or with bolts 48 threaded into triangular plate 36. As best seen in FIG. 3, a head of bolt 48 may be enlarged for seating on the same cross tie 22 supporting L-shaped support 38. Nuts 50 fix the length of the bolt shank threaded into outriggers 46 or triangular support plate 36.

Figure 4:
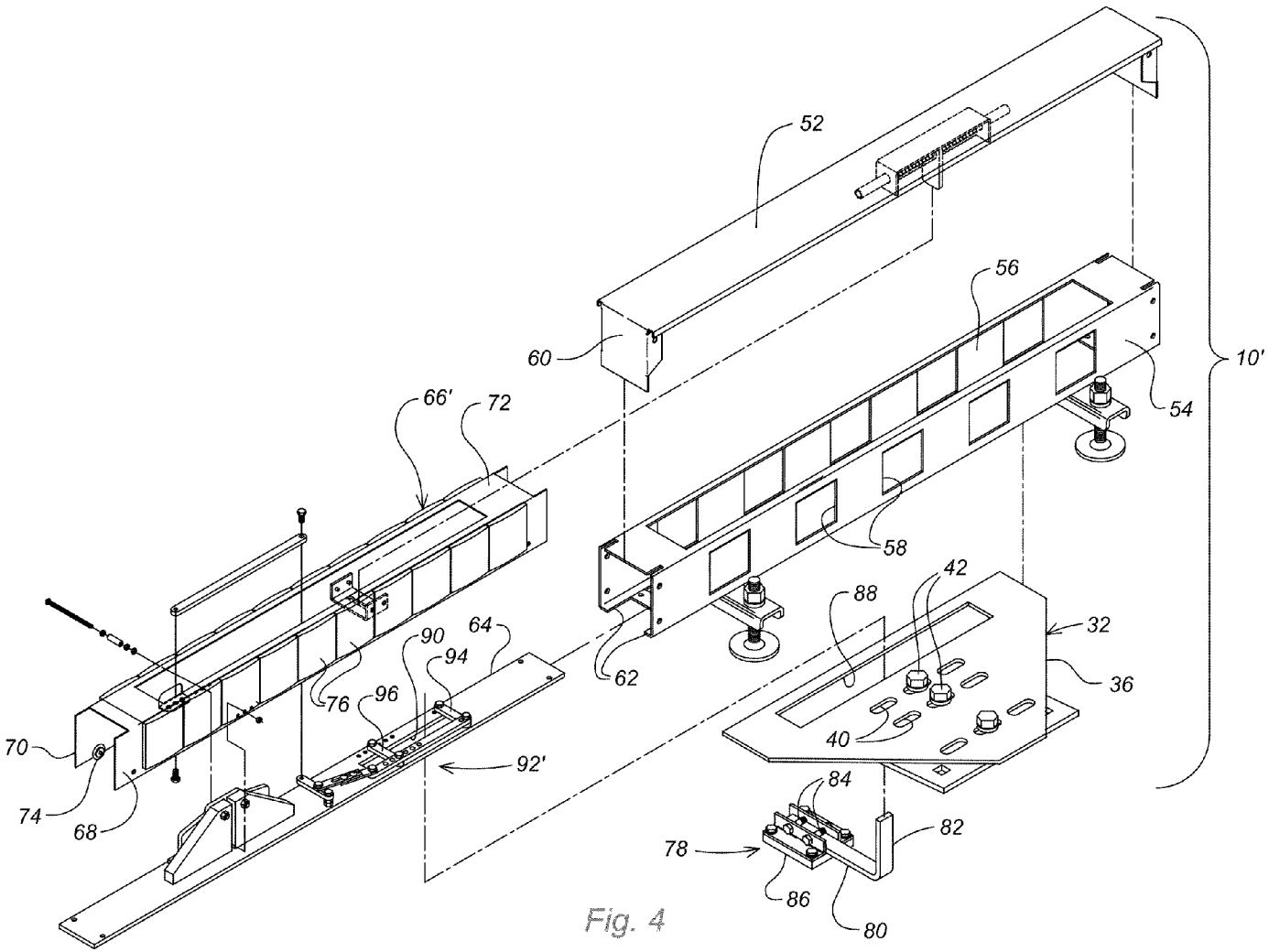
FIG. 4 is an exploded perspective view of the railroad switch indicator.

In switch indicator 10' as shown in FIGS. 4 through 8, sleeve 44 has a top wall 52 and front and rear walls 54,56, respectively, and is mounted between and transverse to stockrails 14, 16 (FIG. 1). Throughout the following discussion, it will be understood that the terms front and rear and right and left are arbitrary as those terms are reversed when switch indicator 10 is viewed from an opposite angle. A plurality of regularly formed, spaced apart windows 58 are formed in front and rear walls 54, 56. End caps 60 may be integrally formed with top wall 52 or welded or attached with suitable fasteners. As discussed below, the lower ends of front and rear walls 54, 56 may be provided with inwardly directed toes 62 upon which an elongated plate 64 as shown in FIG. 4 is attached. As shown in FIGS. 4 and 5A-5C, a first slide 66' rides upon elongated plate 64 or as shown in FIG. 9, toes 62 may form a slideway for a second slide 66".

With reference to FIGS. 4 through 8, slide 66' has front and rear elongated walls 68, 70, respectively attached to a top wall 72. A pair of rollers 74 are provided upon which slide 66' rides on plate 64 in sleeve 44. A plurality of reflectors 76, of alternating color such as 76R and 76G (FIGS. 2A-2C and FIGS. 7A-7C) to indicate different track conditions, are provided on front and rear walls 68, 70 such that railroad switch indicator 10' (FIG. 4), 10" (FIG. 9) is reversible. In FIGS. 11A-11C, reflectors 76 are colored green 76G and amber 76A with alternating reflectors on front wall 68 in substantial alignment with alternating reflectors on rear wall 70. Reflectors 76 include reflecting surfaces for reflecting the rays from the headlight of an approaching train, so as to give the operator an indication of the condition of the track or the switch. Reflectors 76 are spaced such that one set of reflectors 76G is visible through windows 58 when left switchpoint 24 is in contact with left stockrail 18 (FIG. 2B) signaling that the track is lined for straight through travel and the other set of reflectors 76R is visible when right switchpoint 26 is in contact with right stockrail 16 (FIG. 2A) indicating that the track is lined to diverge. A mixture of reflectors 76R and 76G in FIG. 2C (or 76A and 76G in FIG. 11C) indicates that switchpoints 24, 26 are in some mid and dangerous position.

Figure 8:
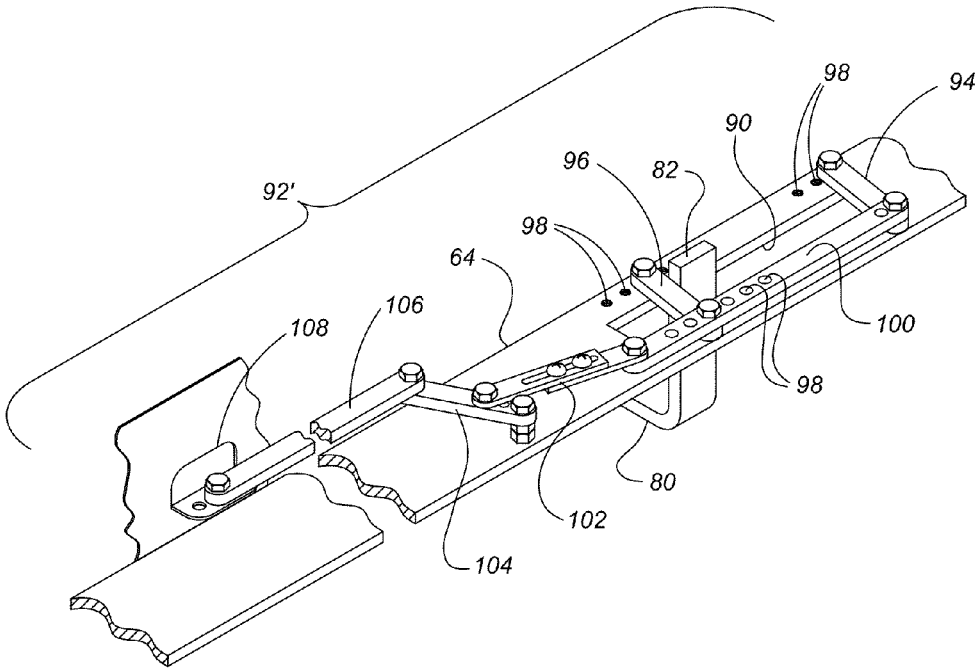
FIG. 8 is a detail on an enlarged scale showing a linkage for amplifying the movement of the switchpoints.
Figure 9:
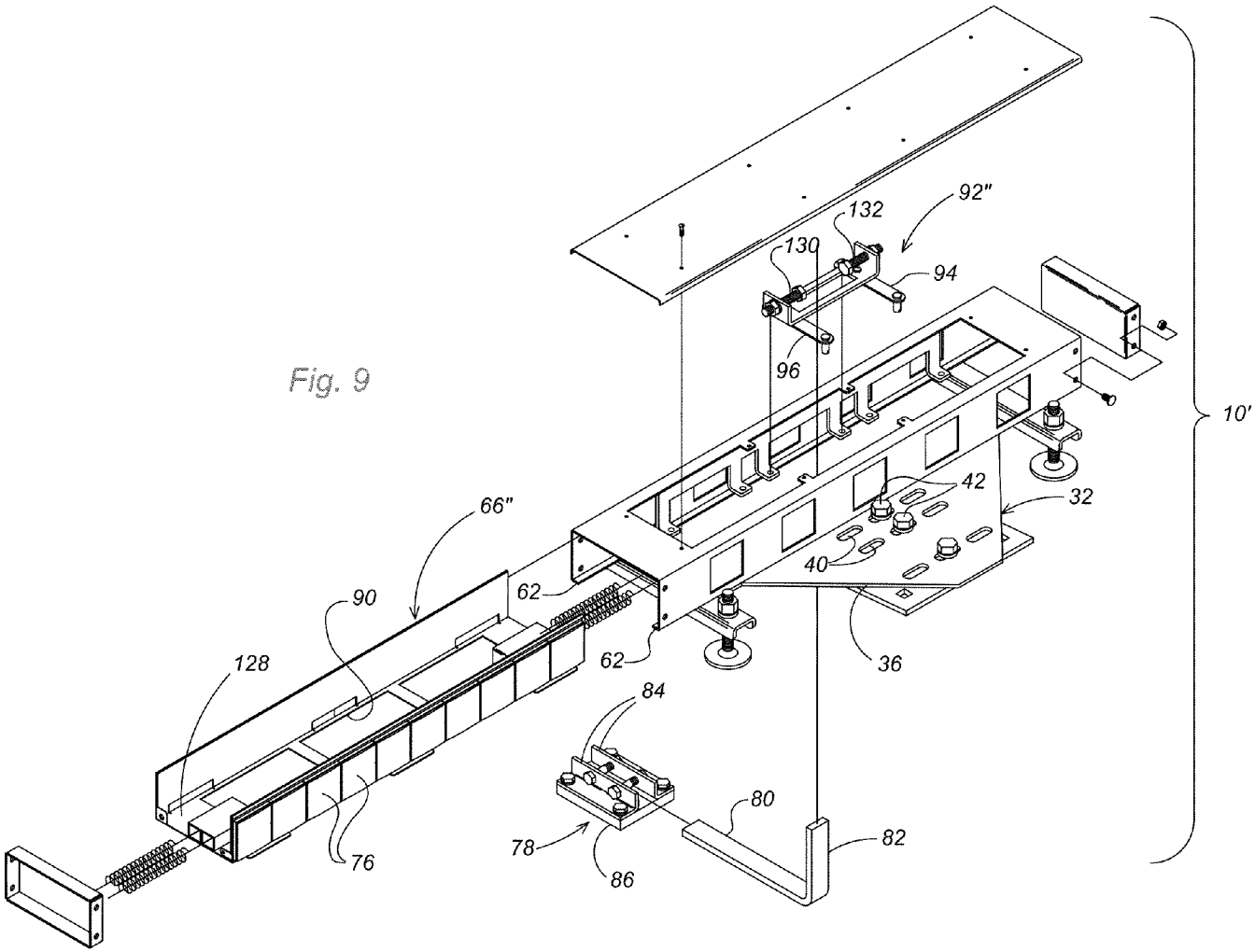
FIG. 9 is an exploded view of a second railroad switch indicator in accordance with the present invention.
Figure 10A:
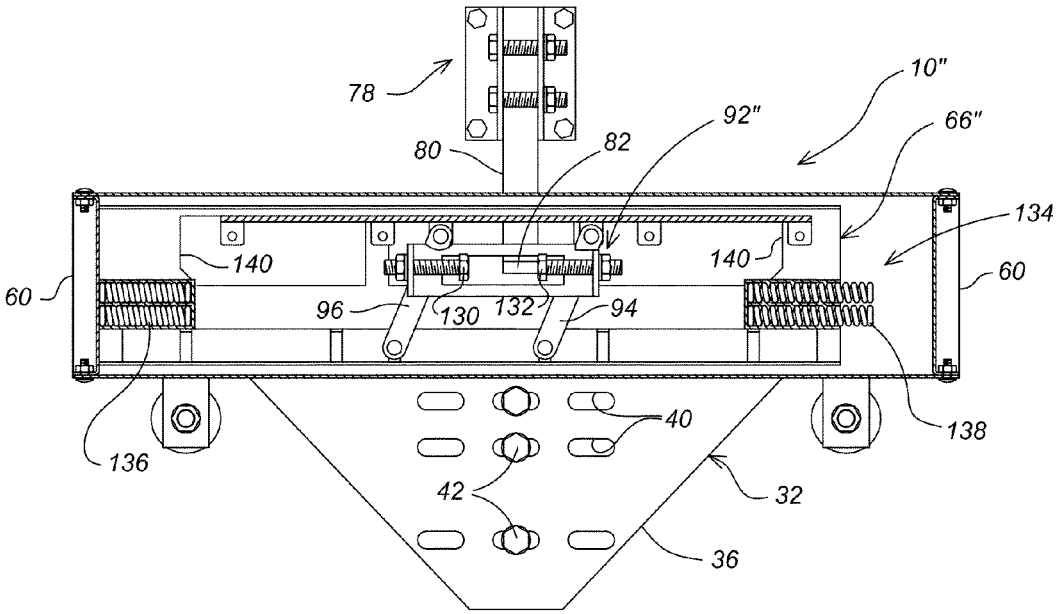
FIG. 10A is a sectional view taken along the plane of 10A-10A in FIG. 11A showing the lever arms pivoted to an extreme right with switchpoint 26 in contact with stockrail 16.

As shown in FIGS. 1, 4 and 9, railroad switch indicator 10 (10', 10") includes a second bracket 78 which is adapted to be attached to transverse bar 28 connected to switchpoints 24, 26. A longitudinally extending arm 80 with an upwardly extending finger 82 is mounted on second bracket 78. As shown in FIGS. 4 and 9, arm 80 may be bolted between a pair of L-shaped brackets 84 mounted on a plate 86. It will be understood that this arrangement permits finger 82 to be moved towards and away from first bracket 32. Thus finger 82 may be made to pass through a first slot 88 (FIG. 4) provided in first bracket 32 and a second, aligned slot 90 in plate 64 best seen in FIG. 8 for reciprocation of slide 66' within sleeve 44 conjointly with movement of transverse bar 28 with switchpoints 24, 26.

As seen in FIG. 8, reciprocation of slide 66' is through a linkage 92' accessible through slot 90 of plate 64. Linkage 92' includes first and second lever arms 94, 96, a first end of which is pivoted on plate 64 of sleeve 44. As shown, lever arms 94, 96 are parallel and pivoted on one side of slot 90. The pivot points of lever arms 94, 96 may be adjustably spaced by use of holes 98. A second end of first and second lever arms 94, 96 is attached to a first link 100. First link 100 like plate 86 includes holes 98 for use in spacing the pivot points of first and second lever arms 94, 96.

A free end of first link 100 is pivoted to a second link 102 which is adjustable in length with elongated slots and bolts to adjust the linkage 92' such that the reflectors 76R or 76A and 76G are properly aligned with windows 60 when switchpoints 24, 26 are in switching or nonswitching position. Second link 102 is pivoted to a third arm 104 which like first and second arms 94, 96 is pivoted at a first end to plate 86 which forms the bottom wall of sleeve 44. A second end of third arm 104 is pivoted to a third link 106 which is connected to a side wall of slide 66' by a bracket 108 as best seen in FIG. 8. When finger 82 contacts either first or second lever arm 94, 96, the distance traveled by the second end of the lever arm is greater than the distance traveled by finger 82. This distance is further amplified by third arm 104 and transferred to slide 66' by third link 106. For example, in one embodiment of switch indicator 10', linkage 92' amplified a ¼ inch movement of switchpoints 24, 26 into a 1.6 inch movement of slide 66'. This movement was designed to be one-half the width of reflectors 76 such that railroad switch indicator 10' signals danger with less than a ¼ inch movement of the switchpoints. In practice, it has also been found that railroad switch indicator 10 (10', 10") is more sensitive if longitudinally extending arm 80 or finger 82 is slightly flexible such that when pressure on lever arms 94, 96 is released, slide 66' (66") is sprung into in mid position more quickly. It will be apparent that even larger movements of slide 66' may be obtained if a fourth lever arm or more (not shown) are added to linkage 92'. Amplification of the movement can also be obtained by increasing the length of the lever arms 94, 96.

Figure 5A:
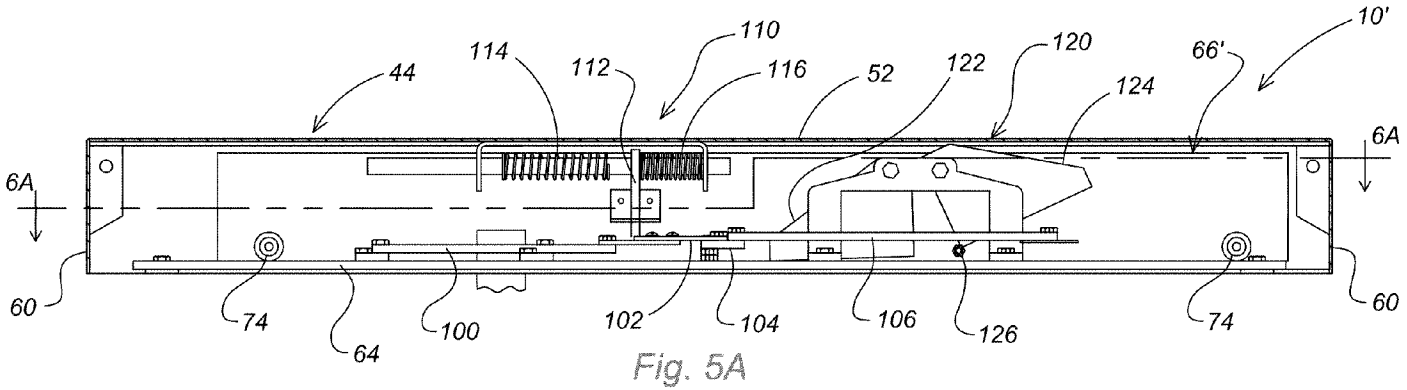
FIG. 5A is a side view in section taken along the plane of 5A-5A in FIG. 6A with a finger pivoting lever arms to the far right when switchpoint 26 is in contact with stockrail 16 in switching or diverging position.
Figure 6A:
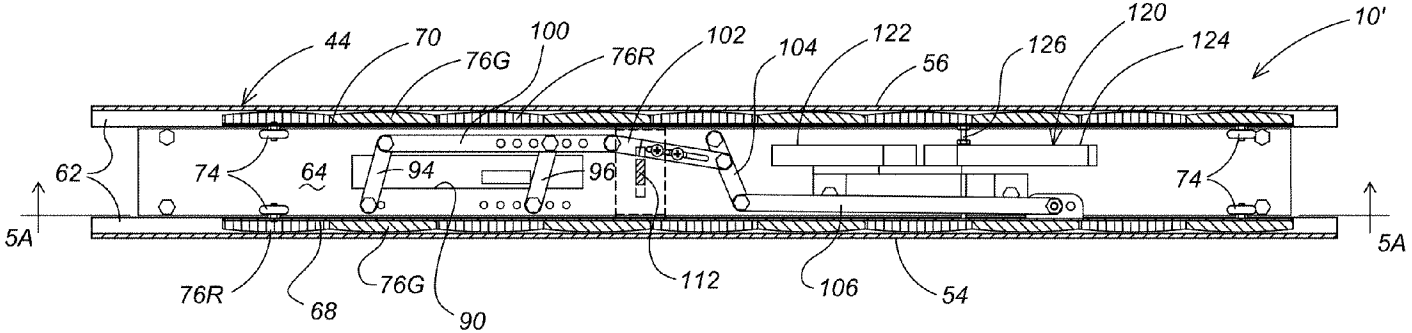
FIG. 6A is a sectional view taken along the plane of 6A-6A in FIG. 5A.
Figure 7A:
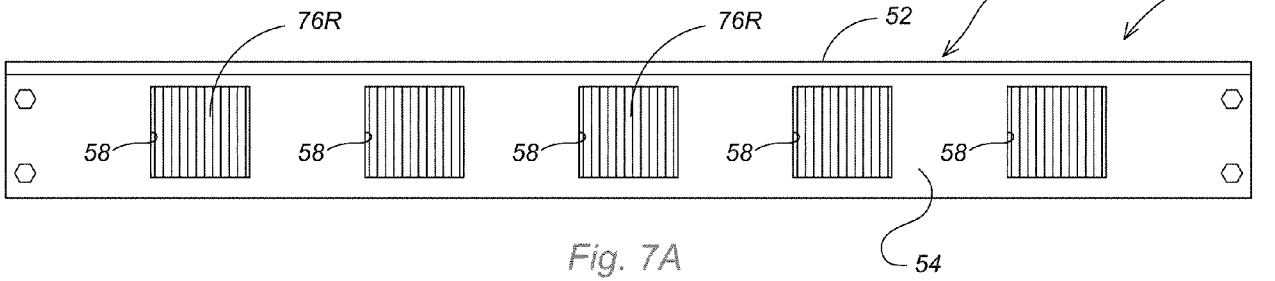
FIG. 7A is a side elevation of the railroad switch indicator signaling switching or diverging condition.
Figure 5B:
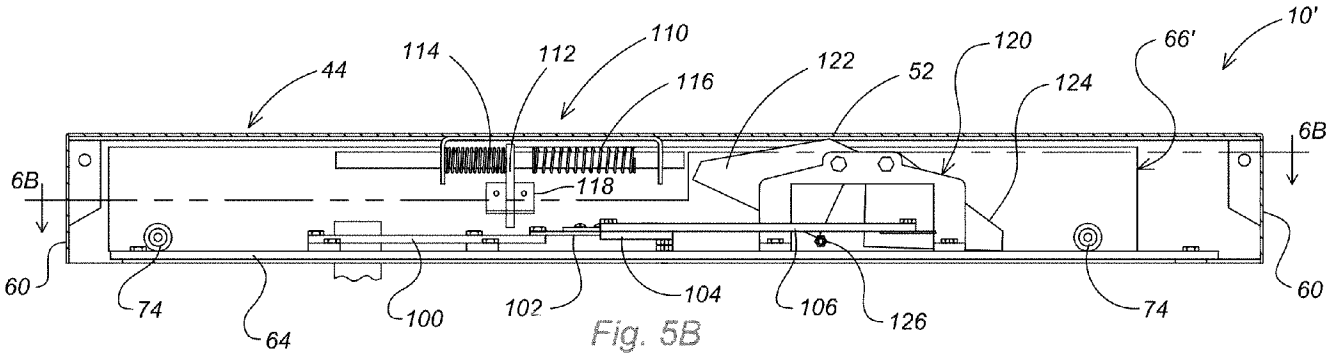
FIG. 5B is a side view in section like FIG. 5A taken along the plane of 5B-5B in FIG. 6B but with the finger pivoting lever arms to the far left when switchpoint 24 is in contact with stockrail 14 in nonswitching, straight or mainline position.
Figure 6B:
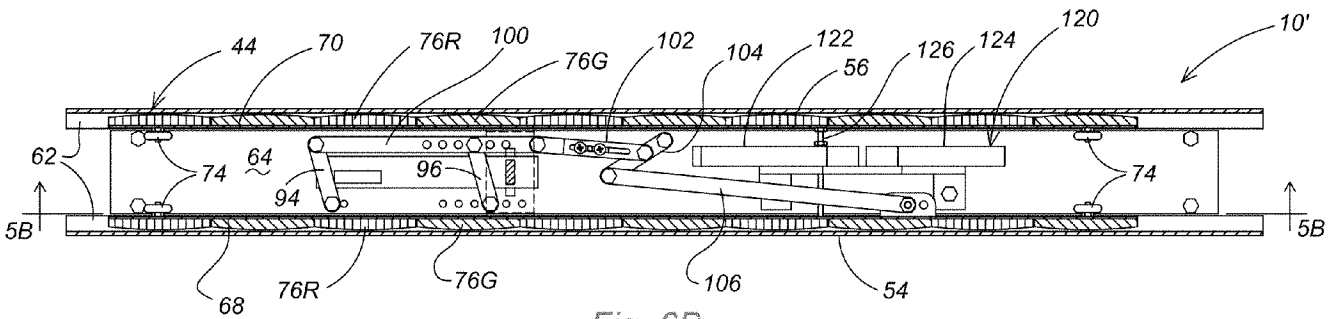
FIG. 6B is a sectional view taken along the plane of 6B-6B in FIG. 5B.
Figure 7B:
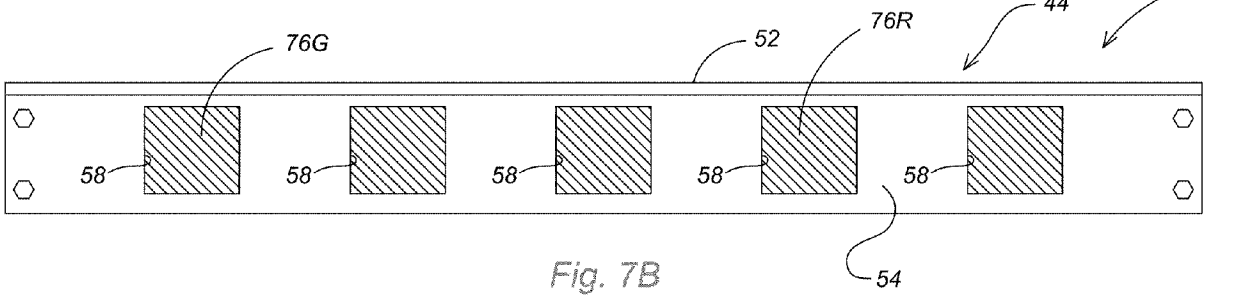
FIG. 7B is a side elevation of the railroad switch indicator signaling nonswitching, straight or mainline condition.

As viewed in FIGS. 5A, 6A and 7A, when finger 82 pivots lever arms 94, 96 to the extreme right first set of reflectors 76R are visible through windows 58 of sleeve 44 indicating that the switchpoints are in switching or diverging position. When finger 82 pivots lever arms 94, 96 to the extreme left as shown in FIGS. 5B, 6B and 7B, second set of reflectors 76G are visible through windows 58 of sleeve 44 indicating that the switchpoints are in nonswitching, straight or mainline position.

Figure 5C:
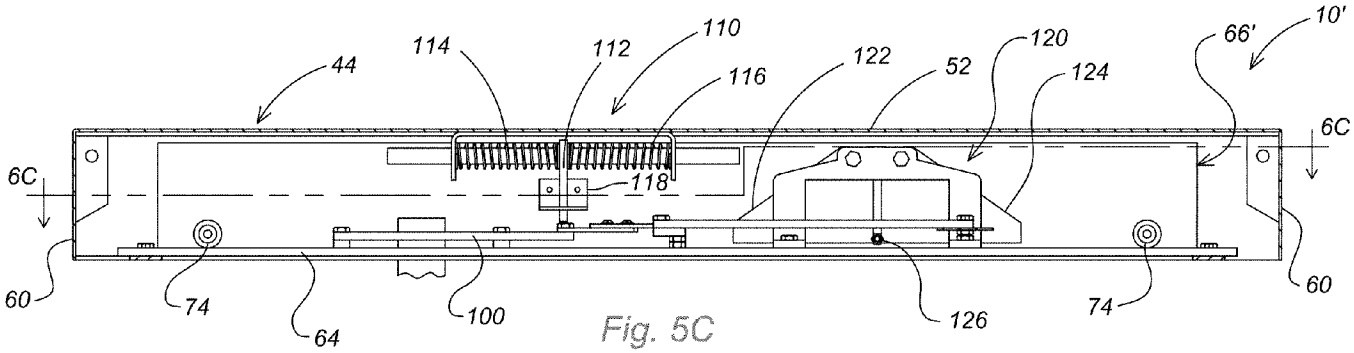
FIG. 5C is a side view in section like FIGS. 5A and 5B taken along the plane of 5C-5C in FIG. 6C but with finger a mid position indicting that the switchpoints are not in proper contact with either stockrail 14 or 16.
Figure 6C:
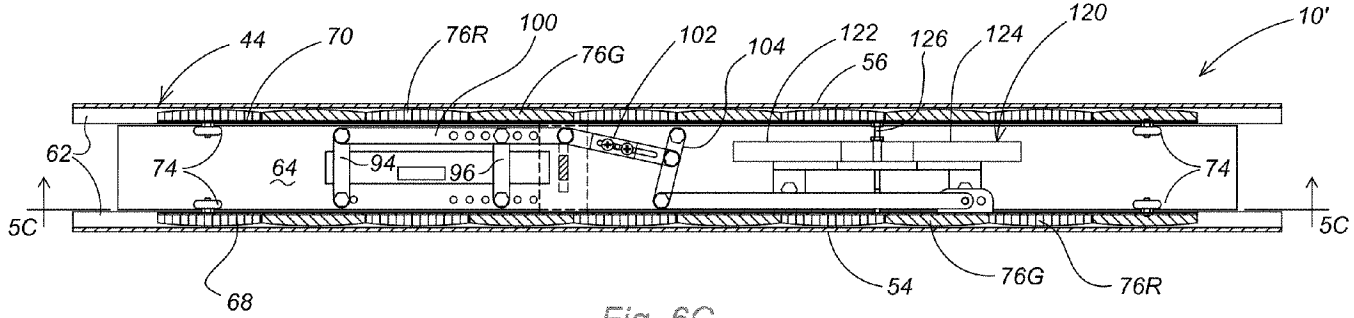
FIG. 6C is a sectional view taken along the plane of 6C-6C in FIG. 5C.
Figure 7C:
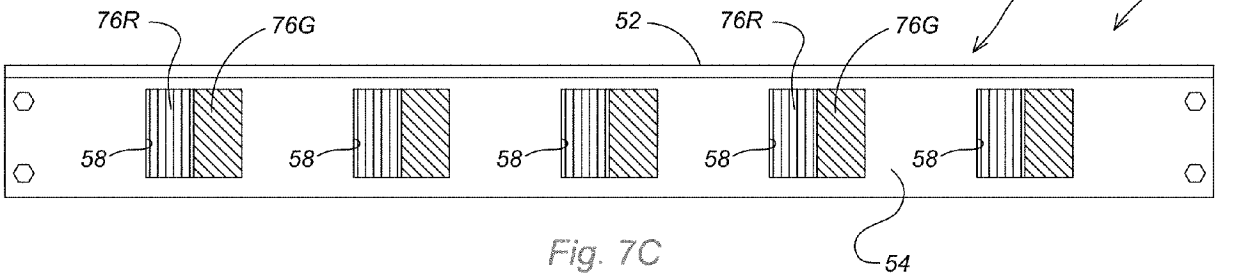
FIG. 7C is a side elevation of the railroad switch indicator signaling danger.

With finger 82 not pressed hard against lever arms 94, 96, slide 66' is urged to center position by a biasing system. As shown in FIGS. 5C, 6C and 7C, this is signaled by first and second set of reflectors 76R or 76A and 76G, portions of which are visible through windows 58 of sleeve 44. A first biasing system 110 includes a tongue 112 which is sandwiched between opposing springs 114, 116 mounted on an underside of top wall 52 of slide 66'. Top wall 72 of slide 66' has elongated aperture through which tongue 112 sticks. Tongue 112 is received in a slot of a bracket 118 that bridges front and rear walls 68,70 of slide 66'. When finger 82 pivots lever arms 94, 96 to the right one of springs 114, 116 is compressed and the other spring is compressed when finger 82 pivots lever arms 94, 96 to the far left. When finger 82 is not pressed hard against lever arms 94, 96, tongue 112 is urged center by springs 94, 96 causing slide 66' to move into mid position.

A second biasing system 120 for moving slide 66' into center position signaling danger includes a pair of pivoted counterweights 122, 124. A rod 126 is provided between front and rear walls 68, 70 and between first and second counterweights 122, 124. When finger 82 pivots lever arms 94, 96 to the right as shown in FIGS. 5A, 6A and 7A, counterweight 124 is lifted by rod 126 and when finger 82 pivots lever arms 94, 96 to the left as shown in FIGS. 5B, 6B and 7B, counterweight 122 is swung up by rod 126. When finger 82 contacts neither of lever arms 94, 96 as shown in FIGS. 5C, 6C and 7C, whichever of counterweights 122, 124 was lifted, pushes slide 66' into mid position with rod 126.

The spacing between the pivot points of lever arms 94, 96 on plate 86 and first link 100 may be adjusted with holes 98 such that arms 94, 96 are in extreme right and left position when the switchpoints are in nonswitching and switching position, respectively. For this it has been found advantageous that the innermost holes 98 be 3½ inches apart. The spacing between the other holes may be different for finer adjustment of the spacing between the pivot points. For example, the spacing may be ½ inch for the holes on the left as viewed in FIG. 8 and 5/16 and ⅜ inch for the holes on the right.

Railroad switch indicator 10" as shown in FIGS. 9 through 11C is similar to switch indicator 10' in many respects. It differs in that slide 66" has a closed bottom 128 with toes 62 of sleeve 44 forming a slideway for slide 66" Like plate 86 of slide 66', bottom 128 has a slot 90 through which finger 82 passes for engagement with a linkage 92". In linkage 92", first end of first and second lever arms 94, 96 is pivoted to sleeve 44 and second end is pivoted to slide 66". As above mentioned, the distance that finger 82 moves slide 66" is amplified by lever arms 94, 96 but not to extent that movement of slide 66' is amplified. For example, it may take a movement of ⅝ inch of switchpoints 18, 20 to move slide 66" 1.6 inch whereas that distance is achieved with a movement of ¼ inch with railroad switch indicator 10'. Another difference between the railroad switch indicators is that in railroad switch indicator 10" the distance between the pivot points of lever arms 94, 96 is fixed. To adjust for the throw of finger 82 between switching and nonswitching position, first and second bolts 130, 132 are threaded into lever arms 94, 96. Finger 82 contacts the heads of bolts 130, 132. Bolts 130, 132 are threaded into lever arms 94, 96 a distance such that when finger 82 contacts the bolt 132 and pushed lever arms 94, 96 to far right, switchpoints 24, 26 are in switching or diverging position indicated by reflectors 76A and when finger 82 contacts bolt 130 and pushed lever arms 94, 96 to far left, switchpoints 24, 26 are in nonswitching, straight or mainline position which is signaled by reflectors 76G. In between position, slide 66" is released and pushed into mid position. Biasing system 134 in railroad switch indicator 10" is different from 10' described above. As shown, compression springs 136, 138 are provided at oppose ends of slide 66" between end caps 60 of sleeve 44 and an end wall 140 of slide 66". When not compressed by action of finger 82 on lever arms 94, 96, springs 136, 138 tend to bias slide 66" into a mid position signalizing danger with a mixture of reflectors 76A and 76G.

In use, it is seen that railroad switch indicators 10' and 10" operate independently of the mechanism for operating switch 30 and have increased sensitivity to movement of switchpoints 24, 26. Because railroad switch indicators 10' and 10" are mechanically linked to switchpoints 24, 26, operation of the indicator does not depend on electricity.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A railroad switch indicator for use with a switch for switching a railroad train including a pair of stockrails and a pair of switchrails, said switchrails having first ends secured to a track bed and second ends terminating with switchpoints, said switchpoints connected by a traverse bar for conjoint lateral movement of the switchpoints between switching and nonswitching positions, said railroad switch indicator comprising a first bracket adapted to be attached to the track bed between the pair of switchpoints, said bracket supporting a sleeve between and transverse to the stockrails, said sleeve having front and rear walls, said front and rear walls having a plurality of regularly formed spaced apart windows, a slide having front and rear walls received in the sleeve, said front and rear walls having a plurality of reflectors, alternate ones forming first and second sets in different colors to indicate safety conditions of the track, the reflectors being visible through the windows of the sleeve, first and second lever arms, each of which having a first end pivoted to the sleeve and a second end pivoted to the slide, a second bracket adapted to be attached to the transverse bar connected to the switchpoints, said bracket supporting a longitudinally extending arm with an upwardly extending finger which engages said lever arms for reciprocation of the slide within the sleeve conjointly with movement of the switchpoints by the transverse bar, said levers arms moving the slide a greater distance than the distance moved by the finger thereby reducing the distance needed to signal a change in the switchpoints, whereby the first set of reflectors are visible through the windows of the sleeve when the switchpoints are in switching position, the second set of reflectors are visible through the windows of the sleeve when the switchpoints are in nonswitching position and portions of the first and second set of reflectors are visible when the switchpoints are in a mid position indicating a dangerous condition.

2. The railroad switch indicator of claim 1 wherein the second end of the first and second lever arms is pivoted to the slide through a linkage comprising a first link pivoted to the second end of the lever arms, said first link pivoted to a third lever arm pivoted to the sleeve at a first end, said third lever arm pivoted at a second end to a second link which is pivoted to the slide.

3. The railroad switch indicator of claim 2 wherein a plurality of holes are provided in the sleeve and in the first link for spacing the pivot points of the first and second lever arms such that the finger pivots them to a first extreme when the switchpoints are in switching position and a second extreme when the switchpoints are in nonswitching position.

4. The railroad switch indicator of claim 1 wherein the longitudinally extending arm and the finger are flexible.

5. The railroad switch indicator of claim 3 further including a biasing means for urging the slide into a position between that when the switchpoints are in switching position and that when the switchpoints are in nonswitching position.

6. The railroad switch indicator of claim 3 wherein a spring biased tongue resists movement of the first and second lever arms by the finger and urges the slide towards a position between that when the switchpoints are in switching position and that when the switchpoints are in nonswitching position.

7. The railroad switch indicator of claim 3 wherein counterweights resist movement of the first and second lever arms by the finger and urges the slide towards a position between that when the switchpoints are in switching position and that when the switchpoints are in nonswitching position.

8. A railroad switch indicator for use with a switch for switching a railroad train including a pair of stockrails and a pair of switchrails, said switchrails having first ends secured to a track bed and second ends terminating with switchpoints, said switchpoints connected by a traverse bar for conjoint lateral movement of the switchpoints between switching and nonswitching positions, said railroad switch indicator comprising a first bracket adapted to be attached to the track bed between the pair of switchpoints, said bracket supporting a sleeve between and transverse to the stockrails, said sleeve having front and rear walls, said front and rear walls having a plurality of regularly formed spaced apart windows, a slide having front and rear walls received in the sleeve, said front and rear walls having a plurality of reflectors, alternate ones forming first and second sets in different colors to indicate safety conditions of the track, the reflectors being visible through the windows of the sleeve, first and second spaced apart parallel lever arms, each of which having a first end pivoted to the sleeve and a second end pivoted to the slide, a second bracket adapted to be attached to the transverse bar connected to the switchpoints, said bracket supporting a longitudinally extending arm with an upwardly extending finger which engages said lever arms for reciprocation of the slide within the sleeve conjointly with movement of the switchpoints by the transverse bar, said levers arms moving the slide a greater distance than the distance moved by the finger thereby reducing the distance needed to signal a change in the switchpoints, said first whereby when the first and second lever arms are pivoted by the finger to a first extreme position and the switchpoints are in switching position the first set of reflectors are visible through the windows of the sleeve and when the levers are pivoted by the finger to a second extreme and the switchpoints are in nonswitching position the second set of reflectors are visible through the windows of the sleeve and when the levers are pivoted by the finger to other than the first and second extreme positions and the switchpoints are in a mid position the first and second set of reflectors are visible indicating a dangerous condition.

9. The railroad switch indicator of claim 8 wherein the second end of the first and second lever arms is pivoted to the slide through a linkage comprising a first link pivoted to the second end of the lever arms, said first link pivoted to a third lever arm pivoted to the sleeve at a first end, said third lever arm pivoted at a second end to a second link pivoted to the slide.

10. The railroad switch indicator of claim 9 wherein a plurality of holes are provided in the sleeve and in the first link for spacing the pivot points of the first and second lever arms such that the finger pivots them to a first extreme when the switchpoints are in switching position and a second extreme when the switchpoints are in nonswitching position.

11. The railroad switch indicator of claim 8 wherein the longitudinally extending arm and the finger are flexible.

12. The railroad switch indicator of claim 10 further including a biasing means for moving the slide into a position between that when the switchpoints are in switching position and that when the switchpoints are in nonswitching position.

13. The railroad switch indicator of claim 10 wherein a spring biased tongue resists movement of the first and second lever arms by the finger and urges the slide towards a position between that when the switchpoints are in switching position and that when the switchpoints are in nonswitching position.

14. The railroad switch indicator of claim 10 wherein counterweights resist movement of the first and second lever arms by the finger and urges the slide towards a position between that when the switchpoints are in switching position and that when the switchpoints are in nonswitching position.

* * * * *